US009232325B2

(12) United States Patent
Hagedorn-Olsen et al.

(10) Patent No.: US 9,232,325 B2
(45) Date of Patent: Jan. 5, 2016

(54) HEARING AID WITH A BUSHING FOR AN EAR WAX GUARD

(71) Applicant: WIDEX A/S, Lynge (DK)

(72) Inventors: Lars Hagedorn-Olsen, Frederikssund (DK); Klaus Henrik Vaarbroe, Skovlunde (DK)

(73) Assignee: WIDEX A/S, Lynge (DK)

( * ) Notice: Subject to any disclaimer, the term of this patent is extended or adjusted under 35 U.S.C. 154(b) by 0 days.

(21) Appl. No.: 14/278,392

(22) Filed: May 15, 2014

(65) Prior Publication Data

US 2014/0247957 A1 Sep. 4, 2014

Related U.S. Application Data

(63) Continuation-in-part of application No. PCT/EP2011/073396, filed on Dec. 20, 2011.

(51) Int. Cl.
*H04R 25/00* (2006.01)

(52) U.S. Cl.
CPC ..... *H04R 25/654* (2013.01)

(58) Field of Classification Search
CPC .... H04R 25/60; H04R 25/604; H04R 25/608; H04R 25/65; H04R 25/652; H04R 2225/025; H04R 2225/77
USPC ..... 381/312, 328, 380
See application file for complete search history.

(56) References Cited

U.S. PATENT DOCUMENTS 4,879,750 A * 11/1989 Nassler ..... 381/325
2005/0169492 A1* 8/2005 Topholm ..... 381/322

FOREIGN PATENT DOCUMENTS

DE 102004062279 A1 5/2006
EP 1097606 B1 10/2005
WO 00/03561 A1 1/2000

OTHER PUBLICATIONS

International Search Report and Written Opinion of ISA for PCT/EP2011/073396 dated Jul. 30, 2012.

* cited by examiner

*Primary Examiner* — Ahmad F Matar
*Assistant Examiner* — Sabrina Diaz
(74) *Attorney, Agent, or Firm* — Sughrue Mion, PLLC

(57) ABSTRACT

A hearing aid (1) with an ear canal part prepared for being arranged in the ear canal. The ear canal part has a sound opening provided with a bushing (6) for receiving an ear wax guard. The bushing comprises an inner tubular part (11) for receiving the ear wax guard, where the inner tubular part is extending inward from the plane formed by the sound opening. The bushing further comprises an outer tubular part (10) extending inward from this plane. The outer tubular part and the inner tubular part are arranged such that a space is formed in between. This space is adapted for receiving a sound guide (5).

8 Claims, 2 Drawing Sheets

HEARING AID WITH A BUSHING FOR AN EAR WAX GUARD

RELATED APPLICATIONS

The present application is a continuation-in-part of application No. PCT/EP2011/073396, filed on Dec. 20, 2011, with the European Patent Office and published as WO 2013/091682 A1.

BACKGROUND OF THE INVENTION

1. Field of the Invention

The present invention relates to hearing aids. The invention more particularly relates to a hearing aid comprising an ear canal part prepared for being arranged in the ear canal of a hearing aid user. The ear canal part has a sound opening which is provided with a bushing for receiving an ear wax guard.

A hearing aid usually has a sound opening or sound outlet in a part arranged in the ear canal of a person using the hearing aid. The sound outlet is an opening connected, e.g. with a sound guide, e.g. a short tubing, to a receiver also arranged in the ear canal part.

2. The Prior Art

The hearing aid may be of different types, where the completely-in-canal type and the in-the-ear type will always be provided with a receiver in the ear canal providing sound through a sound opening. In order to avoid ear wax from the human ear canal to enter through this sound opening, an ear wax guard is usually applied. Such an ear wax guard is known from EP-B1-1097606.

Ear wax guards are exchangeable and need to be replaced on a regular basis in order not to have the sound outlet blocked by ear wax. The time between changes of the ear wax guard varies between persons, because the amount of ear wax produced differs from person to person.

The ear wax guard is usually placed in a bushing into which it is fixed, e.g. by friction or by some clicking means. This means that some manipulation is necessary in order to remove a used ear wax guard and to insert a new one.

It has been found that this frequent manipulation results in that the bushing comes off the ear mold or hearing aid shell, or is loosened from it.

SUMMARY OF THE INVENTION

The invention, in a first aspect, provides a hearing aid having an ear canal part prepared for being arranged in the ear canal, said ear canal part having a sound opening provided with a bushing for receiving an ear wax guard, said bushing comprising an inner tubular part for receiving the ear wax guard, said inner tubular part extending inward from the plane formed by the sound opening, and an outer tubular part extending inward from said plane, arranged such that a space is formed between said outer tubular part and said inner tubular part, said space being adapted for receiving a sound guide.

The advantage of the solution is that the outer tubular part can provide a significantly larger contact area to the ear mold material compared to previously known solutions. Therefore, the connection between the bushing and the ear mold material can also be made significantly stronger.

In an embodiment of the hearing aid the inner and outer tubular parts are connected in the plane formed by said sound opening. This makes it easier to arrange one end of the sound tube between the inner and outer tubular parts.

In an embodiment of the hearing aid the bushing is provided with means for holding the ear wax guard in position. This provides a simple way to hold the ear wax guard in position.

In an embodiment of the hearing aid the bushing is made from a metal. This provides for a strong bushing which is more resistant to wear than one made from a plastic material.

In an embodiment of the hearing aid the hearing aid is an in-the-ear hearing aid.

In a further embodiment of the hearing aid the outer tubular part is shorter than said inner tubular part. This makes it easier to arrange the sound tube in the space between the inner and outer tubular parts.

In a further embodiment the outer tubular part is attached to the ear mold by gluing. This provides for a strong attachment which is easy to handle in the manufacturing process.

The invention, in a second aspect, provides a method for manufacturing an ear canal part of a hearing aid comprising arranging a bushing into the sound opening of a custom fitted ear mold, said bushing comprising an inner tubular part extending inward from the plane formed by the sound opening and an outer tubular part extending inward from said plane; providing a sound guide; and arranging said sound tube to extend from a receiver in the ear mold and to the space formed between said outer tubular part and said inner tubular part of the bushing.

BRIEF DESCRIPTION OF THE DRAWINGS

Some embodiments will now be explained in further detail with reference to the drawings.

DETAILED DESCRIPTION OF THE INVENTION

Figure 1:
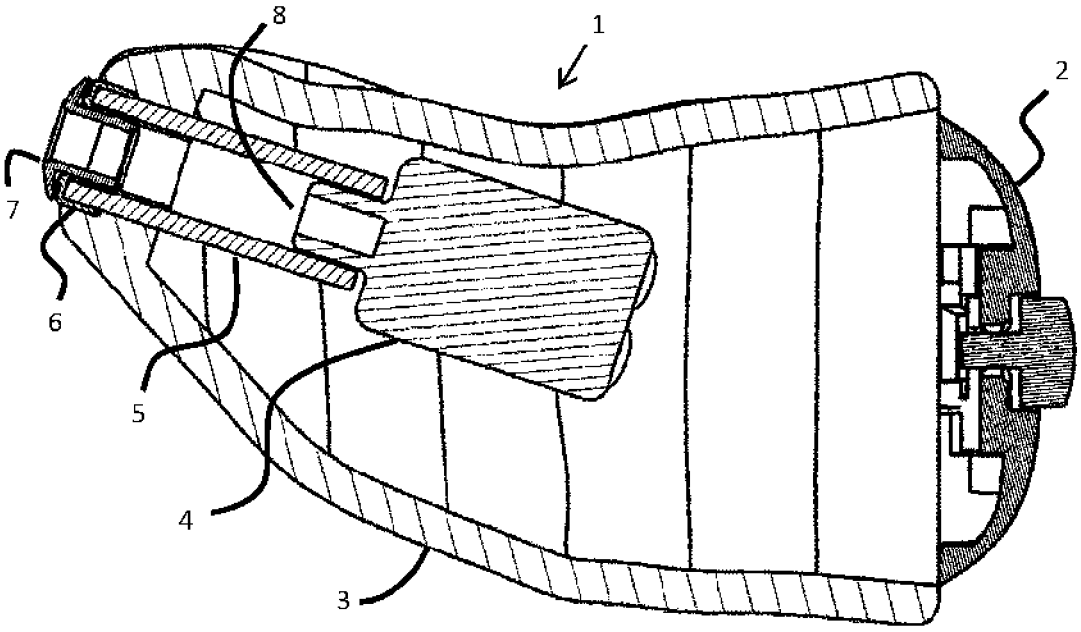
FIG. 1 illustrates an in-the-ear hearing aid with a bushing and an ear wax guard.

FIG. 1 shows an in-the-ear hearing aid 1 having a faceplate 2 with microphone opening (not shown) and hinge for battery replacement (not shown). The face plate is connected to a mold 3 which is often shaped to the individual ear canal of the person to use the hearing aid. The other components of the hearing aid are arranged within the mold. These components (not shown) include one or two microphones, an electronic module and a battery. Further to these a receiver 4 for providing the sound output is also arranged in the ear mold 3.

The ear mold is often manufactured in a rapid prototyping process, and is made from a plastic such as acrylic. A rapid prototyping process is based on an impression of the ear canal which is digitized and used for the design of the ear mold in a computer. The ear mold is then manufactured in a 3-D printer. This provides an easy way of custom fitting the ear mold.

The receiver 4 is provided with a sound outlet 8, where a sound tube 5 is connected to the sound outlet 8. The sound tube 5 is arranged to guide the sound out of the hearing aid and into the ear canal of the user. The sound tube 5 is usually made from a flexible material such as rubber.

The sound tube 5 is connected to a bushing 6 which is secured to the ear mold material. The bushing is adapted to receive an ear wax guard 7 which is replaceable.

The bushing can also be applied in a hearing aid placed behind the ear with a connection to an ear canal part, e.g. an ear plug or an ear mold. The ear canal part may comprise a receiver and a sound tube where an ear wax guard is necessary to protect the receiver, i.e. similar to FIG. 1. The receiver will in that case be connected through a wire to the behind-the-ear part. The receiver may alternatively be arranged in the behind-the-ear part and connected to the ear canal part through a sound tube. Such a sound tube could also be connected to the bushing 6.

Figure 2:
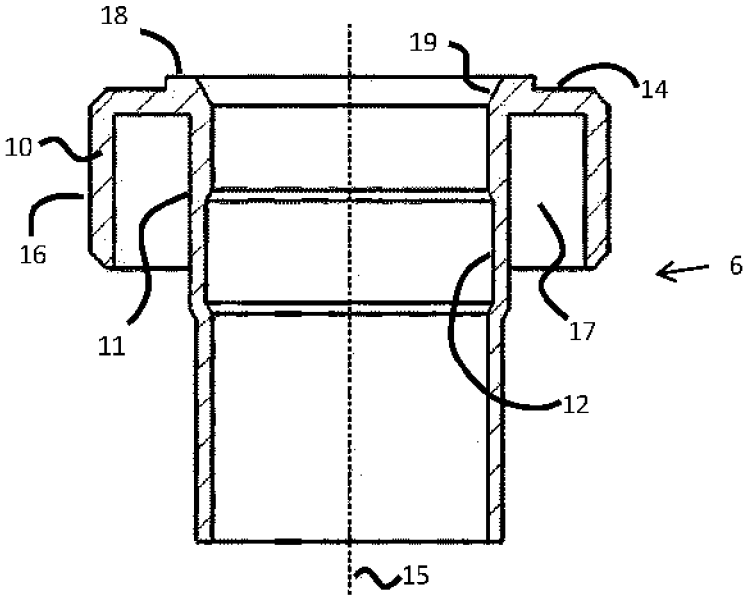
FIG. 2 illustrates a bushing having an inner tubular part and an outer tubular part.

FIG. 2 shows a closer view of a bushing 6. The bushing is symmetrical around the axis 15. The bushing 6 comprises an inner tubular part 11 which is adapted to fit into the sound tube 5 or sound guide. The bushing also comprises an outer tubular part 10, which on its outer surface 16 is attached to the material of the ear mold 3. This attachment will typically be performed by application of glue.

The two tubular parts 10, 11 of the bushing 6 are arranged such that they will form an intermediate space 17. This space 17 is given a shape such that the sound tube 5 or sound guide will fit into this space 17. The bushing 6 should be manufactured such that the sound tube will fit exactly in between the two tubular parts. The sound tube is fixed to the two tubular parts by gluing to both the inner tubular part and to the surface of the outer tubular part facing the inner tubular part. This will also offer a very strong connection between the sound tube and the bushing, which is important since the sound tube and receiver are not necessarily connected to other parts of the hearing aid except for the electrical wires to the electronic part. Often cyanoacrylate glue is used for connecting the bushing and the sound tube.

The inside of the inner tubular part 11 of the bushing 6 is provided with means 12 for receiving an ear wax guard 7. This means for receiving an ear wax guard is illustrated as a recess 12 or an indentation into which the ear wax guard may be locked. Other means for receiving an ear wax guard and holding this in the correct position are also possible. This could be a notch, a platform type area or a kind of bayonet socket. The ear wax guard should be easily replaceable but it must also be kept safely in position during use of the hearing aid, since ear wax entering the receiver may destroy this.

The inner tubular part 11 and the outer tubular part 10 of the bushing 6 are connected. This connection may be through the flange like portion 14.

The bushing 6 will typically be made from a metal, such as steel or brass. It has been found that in order to achieve an optimal strength of the gluing when attaching the bushing to the ear mold material and the sound tube it is preferable if the surface is not too smooth. In order to achieve an optimal roughness of the metal surface an etching of the bushing is performed by dipping it into acid. This improves the strength of the glued attachment of the bushing to the sound tube and to the ear mold.

The bushing will typically have a length in the range 2-2.5 mm, which is also the length of the inner tubular part. The outer tubular part will often have a length of approximately 1 mm, and the length of the outer part should preferably be at least 0.75 mm. The inner tubular part will typically have a diameter of approximately 1.5 mm, whereas the outer tubular part will typically have a diameter of approximately 2.5 mm.

The relationship between the length of the outer tubular part and the diameter of the outer tubular part is important for the strength of the bushing towards forces such as shearing and bending the bushing when e.g. exchanging the ear wax guard. In order to have a sufficient strength of the attachment of the bushing to the ear mold material, the length of the outer tubular part should make up at least 20% of the diameter of the outer tubular part. Preferably, this length should make up at least 25% of the diameter.

The thickness of the metal material used for the bushing is typically in the range 0.075 to 0.18 mm. This thickness will vary for different parts of the bushing.

In general the bushing for one hearing aid model will be manufactured with the same dimensions, even though there may be major variations in the dimensions of the custom fitted ear mold.

FIG. 2 further shows a protrusion 18 from the flange like portion 14. A small edge between the flange like portion 14 and the protrusion 18 is thereby formed. When the bushing 6 has been arranged in the ear mold and fixed to this by gluing, a varnish is applied to the surface of the ear mold. It is important that this varnish does not enter the sound opening, or that a part of the varnish ends on the surface against which the ear wax guard is placed. Since the ear wax guard is placed against the protrusion 18, the small edge between the flange like portion 14 and the protrusion 18 will protect the protrusion 18 from being covered with vanish. If varnish were applied to the protrusion 18 the distance to the means 12 for receiving an ear wax guide would no longer fit with the dimensions of the ear wax guide.

The sloped or flared edge 19 surrounding the sound opening of the bushing has the purpose of making it easier to insert a new ear wax guard.

Figure 3:
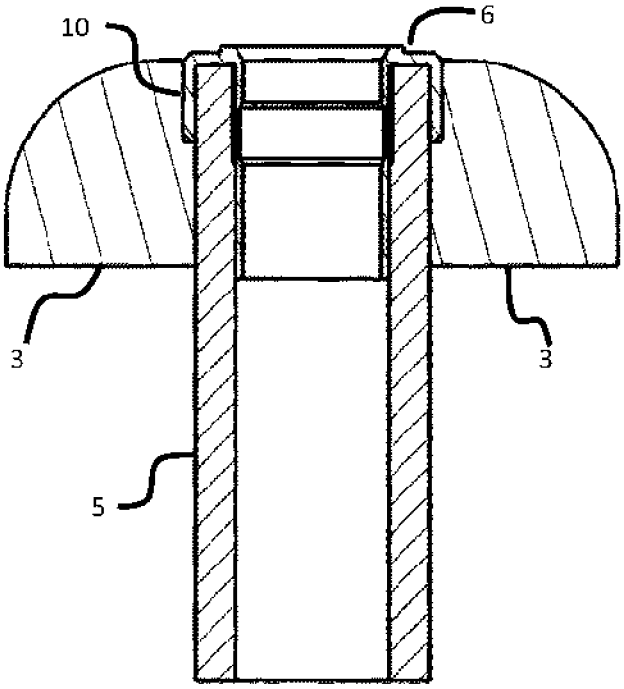
FIG. 3 illustrates the bushing of FIG. 2 arranged in the ear mold material and with a sound guide.

FIG. 3 shows the sound guide or sound tube inserted into the space 17 formed between the inner and outer tubular parts 10, 11 of the bushing. The dimensions of this space 17 should be prepared such that the sound tube will fit exactly. The bushing 6 is arranged in the material 3 of the ear mold, and will typically be fixed by gluing.

The sound opening into which the ear wax guard is inserted is arranged at the end of the ear mold or hearing aid shell facing the ear drum when the hearing aid is in use. The sound opening is formed by a hole in the ear mold or hearing aid shell into which the bushing is arranged. This sound opening will form a plane which will be perpendicular or substantially perpendicular to the axis of symmetry 15 of the bushing 6.

When using the term tubular in the above, it should be understood that this is not necessarily a perfect circular shape, but more to be understood as substantially tubular. Both the inner tubular part and the outer tubular part may be provided with recesses and projections, e.g. for the purpose of further attachment.

We claim:

1. A hearing aid having an ear canal part prepared for being arranged in the ear canal, said ear canal part having a sound opening provided with a bushing for receiving an ear wax guard, said bushing comprising an inner tubular part for receiving the ear wax guard, said inner tubular part extending inward from the plane formed by the sound opening; and an outer tubular part extending inward from said plane, arranged such that a space is formed between said outer tubular part and said inner tubular part, said space being adapted for receiving a sound guide.

2. The hearing aid according to claim 1, wherein said inner and outer tubular parts are connected in the plane formed by said sound opening.

3. The hearing aid according to claim 1, wherein said bushing is provided with means for holding the ear wax guard in position.

4. The hearing aid according to claim 1, wherein said bushing is made from a metal.

5. The hearing aid according to claim 1, wherein the hearing aid is an in-the-ear hearing aid.

6. The hearing aid according to claim 1, wherein said outer tubular part is shorter than said inner tubular part.

7. The hearing aid according to claim 1, wherein said outer tubular part has a length which is at least 25% of the outer diameter of the bushing.

8. The hearing aid according to claim 1, wherein said outer tubular part is attached to the ear canal part by gluing.

* * * * *